US005411104A

United States Patent [19]

Stanley

[11] Patent Number: 5,411,104

[45] Date of Patent: May 2, 1995

[54] COALBED METHANE DRILLING

[75] Inventor: Matthew L. Stanley, Midland, Tex.

[73] Assignee: Conoco Inc., Ponca City, Okla.

[21] Appl. No.: 197,440

[22] Filed: Feb. 16, 1994

[51] Int. Cl.[6] ..... E21B 7/00

[52] U.S. Cl. ..... 175/65; 175/61

[58] Field of Search ..... 175/61, 62, 65, 67, 175/68, 71

[56] References Cited

U.S. PATENT DOCUMENTS 3,873,156 3/1975 Jacoby ..... 175/61 X
4,304,308 12/1981 Munding et al. ..... 166/61 X
4,333,539 6/1982 Lyons et al. .
4,432,423 2/1984 Lyons et al. .

*Primary Examiner*—Michael Powell Buiz
*Attorney, Agent, or Firm*—John E. Holder

[57] ABSTRACT

A system for drilling low rate coalbed formations wherein the formation has anisotropic fracture characteristics which create low permeability (high volatile B bituminous rank or lower). Typically these coalbeds have vitrinite reflectance less than 0.78 $R_o$. The system includes drilling and completing these formation with a horizontal borehole that is drilled with a gas turbine in an underbalanced pressure condition relative to the pressure of the formation. The horizontal borehole is drilled substantially transverse to the general direction of face cleats within the coalbed.

9 Claims, No Drawings

COALBED METHANE DRILLING

BACKGROUND OF THE INVENTION

During the process of coalification, a coalbed, under pressure and temperature, generates gases as well as a cleat (natural fracture) system. The cleat or fracture system is what allows gas and other fluids to flow from high flow potential to low flow potential areas in the coalbed. In the petroleum industry, the fluids of commercial interest are generally hydrocarbons, particularly methane. In areas where the coal is very well cleated and has good permeability, a vertical well can often provide for good recovery of the coalbed gases because of the high flow capacity of the reservoir(s). Cavitation completions can further enhance recovery in these wells. In lower permeability areas, vertical wells typically have to be fracture-stimulated for commercial production, and recovery efficiency is still commonly very poor because of low flow capacity.

This invention relates to a technique for drilling into coalbed methane formations and more particularly to drilling horizontal boreholes into coalbed methane yielding formations using a gas or mixture of gases as the drilling fluid.

Coalbed methane reserves of the Fruitland formation in the San Juan basin of northwest New Mexico and southeast Colorado were only recently tapped extensively as a commercial project. In the rush for companies to develop acreage and qualify wells for lucrative tax credits, many marginally economic wells were drilled and completed. Whereas some areas of the basin have coal seams with good permeability, providing for completions which yield high rates of return on investment, many areas have relatively low permeability and are not yielding good rates of return.

The original gas-in-place estimate for the Fruitland coalbeds is over 60 TCF, but only a small percentage of this reserve will be recovered from existing completions. In the areas of the basin which have low rate coalbed methane wells, significant upside potential exists if horizontal drilling in these formations can be effectively accomplished.

Fruitland formation coalbeds are generally high-volatile bituminous type A or B coals, with the majority of the lower rate coalbed methane wells completed in the less mature type B coals. These particular coalbeds exhibit a pattern of increasing maturity from the southern to the northern areas of the San Juan Basin as documented by published maps of vitrinite reflectance ($R_m$ or $R_o$) data which range from less than 0.5 (sub-bituminous) to greater than 1.5 (low volatile bituminous). Vitrinite reflectance is a commonly used geological method for estimating the thermal maturity of organic material. The technique for determining this parameter involves measuring a reflectance characteristic of vitrinite material in the coal with $R_m$ being a mean reflectance value and $R_o$ being an interpretive number that is derived from a hystogram or plot of values wherein scattered data that is not representative of the overall character of the material is removed. Lab reports of these measurements are typically given as $R_o$, which is more representative of the true character of the reservoir material. Vitrinite reflectance measurement is described in more detail by Ting F.T.C. (1991) "Review of Vitrinite Reflectance Techniques and Applications", Organic Geochemistry, Vol. 17, pp. 269–270 and by Kilby W. E. (1991) "Vitrinite Reflectance Measurement Same Technique Enhancements and Relationships", International Journal of Coal Geology, Vol. 19, pp. 201–218. A transition from high permeability to low permeability coal is coincident with a vitrinite reflectance of about 0.78 R. The majority of the low rate coalbed methane wells are located in areas where $R_o$ is less than 0.78 and the coals are ranked in the high volatile B bituminous or medium volatile bituminous grades. The Fruitland coalbed reservoirs are naturally fractured (cleated), containing both face and butt cleats as well as joints. In areas of higher permeability (i.e. generally coals with high volatile A bituminous rank or greater, ($R_o>0.78$)), properly completed vertical wells communicate effectively with the cleat system and are capable of efficiently draining the methane resources. In areas with lower permeability (i.e. coals with high volatile B bituminous rank or lower, ($R_o>0.78$)) not only is the overall effective permeability lower, but the anisotropy is greater, resulting in vertical well completions which are not efficiently producing the methane resources. Most of the wells in these low permeability areas have been fracture stimulated in an attempt to improve the production rate of the well but the results have been disappointing.

Basic rock mechanics concepts can be used to determine what orientation an induced fracture will assume. In the Fruitland coal seams, the orientation will be parallel to the face cleat system. Because of the anisotropy which exists, the propped fracture, by paralleling the higher permeability face cleats, does not maximize the production potential of the coal seams. Additionally, there is evidence that the induced fractures are inefficient because of apparent damage to the near-fracture area caused by compression of adjacent face cleats, swelling of in-situ clays, plugging by fluid additives, and/or swelling of the coal by water. Data and analyses in recently published literature indicates that the optimal completion of a vertical coal seam well is a cavitation completion or a completion which utilizes multiple fracture stimulations which may eventually orient perpendicular to the face cleats if the current stress orientations are favorable. In summary, it is generally believed that the current vertical well completions in the low permeability coal seams are not optimally drilled or stimulated.

Attempts to stimulate production from coalbed formations have included such techniques as (1) cavitation as shown in U.S. Pat. No. 4,305,464, (2) fracture-stimulation with various fluids and slurries, (3) cavitation of an open hole section by injection for example of air into coal followed by a rapid release (4) high pressure injection of a gas followed by rapid release of pressure to improve near-wellbore permeability as shown in U.S. Pat. No. 5,014,788, (5) horizontal drain holes, etc.

Induced hydraulic fractures in coal reservoirs are less effective than desired for the following reasons: (a) Hydraulic fractures do not cross-cut face cleats that are the most permeable pathways for fluid flow. Test data suggests that near wellbore permeability is less than that of pre-existing natural fractures located at greater distances from the well; (b) hydraulic fracture emplacement may cause increased horizontal stress and cleat aperture decrease with permeability decrease in the reservoir adjacent the induced fracture. To accommodate the volume of induced fractures, face cleats may be compressed distances on the order of 50 feet from the induced fracture with corresponding reduced permeability of one fourth to one tenth the original face cleat permeability; (c) the effective length and conductivity of the induced hydraulic fracture may be much less than designed due to complex induced fracture geometry and lithologic variation; (d) fracture fluids used to carry the proppant cause formation damage that reduces near permeability; and (e) hydraulic fracture gels may not break completely to leave residue that may plug cleats.

It is therefore an object of the present invention to overcome the problems associated with the development of low permeability, high anisotropy coalbed formations by using new and improved drilling techniques.

It is further the object of this invention to utilize gas or a mixture of gases as a drilling fluid medium for drilling and completing horizontal coalbed methane wells.

It is a still further object to optimize the natural permeability by drilling underbalanced and orienting the drilling direction to maximize intersection of the borehole and face cleats in the formation.

SUMMARY OF THE INVENTION

With these and other objects in view the present invention contemplates economically producing from coalbed formations where the permeability is less than approximately 0.5 millidarcy, vitrinite reflectance is less than about 0.78 $R_o$, and the production zone is underpressured; by drilling a horizontal/high angle borehole into the coalbed at an angle such that the wellbore's exposure to the natural fractures is increased (over vertical wells), using a gas or mixture of gases (with minor amounts of liquid(s)) as the drilling fluid. By using gas for cuttings removal, bit cooling, etc. during the drilling of the well, the damage of the near wellbore area which occurs if a liquid system is used, is minimized, the flow capacity of the well is increased, and a more efficient recovery of fluids (or injection) is obtained. In addition, the drilling of the coalbed will most commonly be in an underbalanced condition, further improving removal of cuttings and other wellbore materials which could otherwise flow into the fracture system and limit flow from the well. Also, the drilling of the horizontal borehole is oriented to maximize intersection of the borehole and face cleats occurring in the formation.

DESCRIPTION OF THE PREFERRED EMBODIMENTS

Horizontal completions using conventional liquid drilling fluids in naturally fractured reservoirs are now quite common in certain areas of the country. In fact, a few mud-drilled horizontal coalbed methane wells have been attempted in the San Juan basin, all of which were economic failures. There are many reasons that the attempts to date have been unsuccessful, including (1) most of the wells were drilled in areas of relatively high permeability where less expensive vertical wells are effective, (2) the wells were drilled in areas where sloughing of the coal causes mechanical problems, and (3) mud and cuttings flowing into the existing natural fractures damaged the wells.

In a typical vertical or horizontal/high angle drilling operation in a coalbed, the pressure of the drilling fluid is greater than that in the reservoir. This overbalance causes drill fluids (including cuttings and other solids) to flow into the natural fractures, reducing the permeability of the near wellbore. The concept presented here will drastically reduce, if not eliminate, the flow of solids and liquids into the fractures from the wellbore, thus greatly improving the flow capacity of the wellbore. While air/gas drilling in coal in a vertical well is common, the concept of using a gas (or mixture of gases) to drill a high angle or horizontal coalbed well is new. Typically, vertical wells through coalbeds don't have difficulty regarding water entry, depending of course on the area being drilled. However, horizontal holes will be more proven to have water entry problems. If you have water entry from the drilled formation, it may be necessary to mist the drilling fluid (gas) in order to lift the water entering the borehole to the surface. Therefore, when the drilling fluid is described as a gas, it is intended to mean a gas including air which may or may no be misted. The high angle/horizontal well will have a higher flow capacity than liquid-drilled wells due to the reduction or elimination of near wellbore damage and because of the increase in contact with the natural fracture system. Both injection and production wells drilled in this manner will benefit from the application of this concept.

In the present technique conventional drilling practices may be used to drill to a point that directional techniques will be used to begin to direct the borehole into a horizontal orientation. As used in this description a horizontal borehole is one that is drilled at a high angle with respect to vertical or that follows the lie of the formation. Conventional drilling mud systems will probably be used to drill this access position of the hole at which time this vertical portion of the hole will likely be cased. The San Juan Basin presently has about 20,000 vertically drilled wells which intersect the Fruitland coalbed formation. These existing wells can serve as access wells to the coalbed for horizontal drilling in accordance with the present technique. Once the top of the coal seam is reached, the lateral hole is drilled using a drilling motor driven by a gas such as air or air in combination with other gases. The lateral portion of the hole is then drilled (say for 2,500') along the top of the coalbed seam (to reduce sloughing problems) and this portion of the well is completed open-hole. While it is thought that drilling along the top of the formation produces better hole conditions; for various reasons, it is not limited to this technique. The high angled or horizontal borehole will have a higher flow capacity than liquid-drilled wells due to the reduction or elimination of near wellbore damage and because of the increase in contact with the natural fracture system. Both injection and production wells drilled in this manner will benefit from the application of this concept. Circulating options for drilling the lateral borehole section include conventional annular cuttings removal and reverse-circulation cuttings removal. Although mechanically more difficult, the reverse-circulation method is desirable from a well damage standpoint.

The formation criteria which will economically support this drilling technique for coalbed applications may include any or all of the following: (1) underpressured production zone, i.e., where formation pressure is less than or approximately less than the hydrostatic column of water; (2) a coalbed formation having an average effective permeability of less than about 0.5 millidarcy or a vitrinite reflectance ($R_o$) less than 0.78; (3) coal seams that are located less than 2000 feet below the earth's surface; and (4) low rate coalbeds having a highly anisotropic character. While the present technique is by its nature more costly to use, under the proper circumstances set forth herein, substantial increases in productivity can be accomplished.

The various individual aspects of the present technique such as, horizontal holes, gas or air motor drilling, open hole completions, various circulation techniques, air-mist and gas mixtures, are all well known in the drilling industry. What is unique in the present application is that by careful analysis of the production problems associated with coalbed methane production, the present invention focuses on uniquely combining these practices with certain low rate coalbed formation criteria to solve a problem which to this point has excluded certain formations from economical production.

It is believed that the shortcomings of the prior art techniques such as described in the Background above may be overcome by the present invention to extend the limits of coal reservoir range in which economically viable completions are possible. The present system optimizes permeability in that it preserves the natural fracture, permeability, and connectivity of the reservoir around the borehole as well as extending the connectivity of the well to the reservoir by use of a horizontal or lateral borehole following the lay of the reservoir. The reservoirs which may be effectively drilled and produced with the present technique are typically high volatile "B" bituminous coal having a "low" permeability of less than 0.5 millidarcy. Another measure of a target reservoir for this technique is that the vitrinite reflectance of the reservoir is predominantly less than 0.78 $R_o$ and the maturity is ranked at or lower than a high volatile B bituminous coal. In addition, in the present system, the production zone is underpressured (less than hydrostatic pressure of a column of water) and the borehole is drilled using gas, air or misted air to operate a gas motor or turbine to drill a lateral hole in the coalbed which typically averages at least 70° to the vertical. A gas turbine drill for use in drilling horizontal holes is disclosed in U.S. Pat. Nos. 4,333,539 and 4,432,423 and is incorporated herein by reference. This turbine drilling motor is small so as to be moved downhole through a small radius curve.

This gas turbine technique for use in the described low rate coalbed formation offers these advantages: (1) the bottom hole circulating pressure can be held below the formation pressure, thus cuttings will be circulated past the natural coalbed fractures rather than flow into the fractures where low permeability exists in the coalbed. Drilling with mud or water in an over balanced condition will cause the drilling fluid to infiltrate what little permeability exits in the near wellbore formation. Any fluid which is used in an overbalanced system will enter the formation thus drilling underbalanced is one important factor of the present system. In high rate formations, drilling underbalanced will likely cause collapse of the less consolidated formation which may be a hindrance to the drilling operation.

The permeability of coal is sometimes difficult to measure. Another characteristic of low permeability coalbeds is that they are underpressured. Underpressured is defined as a formation pressure less than an equivalent column of water at the depth of the formation. If formation pressure is less than the hydrostatic pressure then fluid will leak into the formation and cause permanent damage. Even a few inches of contamination will permanently damage the formation. Clays in the coal will swell in reaction to water. Other minerals present in the coal will also react to water to damage the formation.

We can therefore define a low rate coal formation as one which has a formation pressure that is approximately less than hydrostatic pressure. Typically the vitrinite reflectance will be less than 0.78 $R_o$. The present completion technique will also apply to areas where the formation pressure is at or slightly above hydrostatic pressure such as 0.47 psi per foot where 0.43 psi per foot represents hydrostatic pressure. Thus, it can be said that this completion technique is applicable to low permeability or low rate reservoirs where the formation pressure is less than about 0.47 psi per foot and vitrinite reflectance is less than 0.78 $R_o$. (2) No mudcake will be formed on the wall of the borehole to interfere with productivity from the natural fracture system, (3) clays in the coal cannot be altered by non-native water because only air, gas, or a mixture of gases is used for drilling and completing. Coal has such low permeability in some formations that anything that effects its permeability substantially affects the production potential. Non-native waters can cause clays to swell in the coal and thus close permeability fractures. With oil base muds, the coal itself will react and swell and thus damage formation permeability. (4) Air, $N_2$ or other gases and gas mixtures stimulate coalbed methane production through a reduction in the partial pressure of methane. If you drill with air there is no methane content in the drilling fluid and therefore, methane in the formation will preferentially diffuse into the air medium of the drilling fluid. This causes the coal to shrink which in turn will increase the fractures between the substructures that make up the coalbed. Therefore, removing methane from the near wellbore region by this mechanism will improve the permeability because as the coal shrinks the natural fractures will increase in size. This is unique to coal in that other petroleum reservoirs are inert structures whereas coal is not inert. (5) The horizontal wellbore takes advantage of anisotropy and heterogeneity which is characteristic of coalbed fracture structure. The coalbed is made up of a substructure. This has a longitudinal characteristic and the long sides or axis of this substructure (face cleats) provide the maximum permeability whereas the short or cross axis of the substructure (butt cleats) provide much less permeability to fluid flow. If you orient drilling of a borehole substantially perpendicular to the face cleat system, you maximize intersection with high permeability fractures. In a conventional sandstone there is no anisotropy and horizontal drilling will simply provide a longer exposure of the borehole to a homogeneous structure. In the low permeability anisotropic or heterogeneous structure of the coalbed formation, drilling across the face cleats should greatly increase production potential within each discrete segment of the formation.

It is the recognition of this combination of events including the anisotropic nature of the low rate formations, the low reservoir pressure, and thus the true nature of the resulting low permeability that has led to the unique application of drilling techniques to overcome the problems of economically drilling and producing low rate coalbed formations.

While particular embodiments of the present invention have been shown and described, it is apparent that changes and modifications may be made without departing from this invention in its broader aspects, and therefore, the aim in the appended claims is to cover all such changes and modifications as fall within the true spirit and scope of this invention.

We claim:

1. A method for drilling a wellbore into a coalbed formation having a low permeability due to the highly anisotropic character of the natural fracture system within the coalbed formation wherein the anisotropic character of the coalbed formation includes face cleats which are longitudinal fractures that provide relatively highly permeable fluid communication paths, and butt cleats which are short transverse fractures that are relatively less permeable to fluid flow and wherein the face and butt cleats follow a generally locally fixed pattern throughout the formation being drilled, and further including the steps of;

drilling or using a hole drilled substantially vertically into or near a coalbed formation;

using primarily air, gas or a mixture of gases as a drilling fluid, drilling a horizontal borehole into the coalbed formation;

determining the general direction of the face cleats within the coalbed formation; and orienting the drilling direction of the horizontal borehole to maximize intersection of the borehole and the face cleats.

2. The method of claim 1 and further wherein the gaseous drilling fluid includes liquid mist.

3. A method for drilling a wellbore into a coalbed formation having a low permeability due to the highly anisotropic character of the natural fracture system within the coalbed formation, comprising;

drilling or using a hole drilled substantially vertically into or near a coalbed formation;

using primarily air, gas or a mixture of gases as a drilling fluid, drilling a horizontal borehole into a coalbed formation having a pressure less than about 0.47 psi per foot of formation depth, and maintaining the drilling fluid in the horizontal borehole at a pressure less than the formation pressure.

4. The method of claim 3 wherein the gaseous drilling fluid includes a liquid mist.

5. A method for drilling a borehole into a low rate coalbed formation having anisotropic fracture characteristics which create low permeability to fluid flow within the formation, comprising the steps of;

drilling or using a previously drilled vertical hole at least to approximately the top of the low rate formation;

drilling a horizontal borehole into the low rate formation using a gas operated drilling motor;

maintaining the drilling fluid underbalanced with respect to the pressure of the low rate formation; and orienting the direction of the horizontal borehole such that the borehole is substantially transverse to the general direction of face cleats within the low rate formation.

6. A method for drilling a wellbore into a coalbed formation having a low permeability due to the highly anisotropic character of the natural fracture system within the coalbed formation, wherein the vitrinite material in the coal has a vitrinite reflectance value of less than 0.78 R, comprising;

drilling or using a hole drilled substantially vertically into or near a coalbed formation;

using primarily air, gas or a mixture of gases as a drilling fluid, drilling a horizontal borehole into the coalbed formation;

maintaining the drilling fluid underbalanced with respect to the pressure of the coalbed formation, wherein the coalbed formation includes face cleats which are longitudinal fractures that provide relatively highly permeable fluid communication paths, and butt cleats which are short transverse fractures that are relatively less permeable to fluid flow and wherein the face and butt cleats follow a generally locally fixed pattern throughout the formation being drilled;

determining the general direction of the face cleats within the coalbed formation; and orienting the drilling direction of the horizontal borehole to maximize intersection of the borehole and the face cleats.

7. A method for drilling a wellbore into a coalbed formation having a low permeability due to the highly anisotropic character of the natural fracture system within the coalbed formation, wherein the vitrinite material in the coal has a vitrinite reflectance value of less than 0.78 R, comprising;

drilling or using a hole drilled substantially vertically into or near a coalbed formation;

using primarily air, gas or a mixture of gases as a drilling fluid, drilling a horizontal borehole into the coalbed formation; and maintaining the drilling fluid in the horizontal borehole at a pressure less than about 0.47 psi per foot of coalbed formation depth.

8. A method for drilling a wellbore into a coalbed formation having a low permeability due to the highly anisotropic character of the natural fracture system within the coalbed formation wherein the anisotropic character of the coalbed formation includes face cleats which are longitudinal fractures that provide relatively highly permeable fluid communication paths, and butt cleats which are short transverse fractures that are relatively less permeable to fluid flow and wherein the face and butt cleats follow a generally locally fixed pattern throughout the formation being drilled, and further including the steps of;

drilling or using a hole drilled substantially vertically into or near a coalbed formation;

determining the general direction of the face cleats within the coalbed formation;

from the substantially vertical hole, drilling a horizontal borehole into the coalbed formation; and orienting the drilling direction of the horizontal borehole to maximize intersection of the borehole and the face cleats.

9. The method of claim 8 wherein a misted gaseous fluid is used as a drilling fluid for drilling the horizontal borehole into the coalbed formation.

* * * * *

UNITED STATES PATENT AND TRADEMARK OFFICE

CERTIFICATE OF CORRECTION

PATENT NO.: 5,411,104

DATED: May 2, 1995

INVENTOR(S): Matthew L. Stanley

It is certified that error appears in the above-identified patent and that said Letters Patent is hereby corrected as shown below:

Column 1, line 59, "or plot of values" should be --or plot of $R_M$ values--.

Column 2, line 17, "($R_o$ > 0.78)" should be --($R_o$ < 0.78)--.

Signed and Sealed this

Fourth Day of July, 1995

Bruce Lehman

*Attest:*

BRUCE LEHMAN

*Attesting Officer*

*Commissioner of Patents and Trademarks*